United States Patent [19]

Miller

[11] 4,074,638

[45] Feb. 21, 1977

[54] APPARATUS FOR AGITATING AND REMOVING NON-COMBUSTIBLE MATERIAL FROM AN INCINERATOR

[75] Inventor: Benjamin U. Miller, Hales Corners, Wis.

[73] Assignee: Kelley Company, Inc., Milwaukee, Wis.

[21] Appl. No.: 705,760

[22] Filed: July 16, 1976

[51] Int. Cl.[2] ..... F23G 5/00; F23K 3/12; F23J 1/00

[52] U.S. Cl. ..... 110/8 R; 110/109; 110/165 R; 214/24

[58] Field of Search ..... 214/23, 24, 54; 110/8 R, 109, 165 R

[56] References Cited

U.S. PATENT DOCUMENTS

| | | | |
|---|---|---|---|
| 1,240,295 | 9/1917 | Atterbury et al. | 214/34 |
| 3,746,521 | 7/1973 | Giddings | 110/8 |
| 3,749,031 | 7/1973 | Burden, Jr. | 110/8 |
| 3,766,866 | 10/1973 | Krumm | 110/8 |
| 3,855,950 | 12/1974 | Hughes, Jr. | 110/109 |

*Primary Examiner*—Kenneth W. Sprague
*Attorney, Agent, or Firm*—Andrus, Sceales, Starke & Sawall

[57] ABSTRACT

An apparatus for agitating and removing ash and non-combustible materials from an incinerator. Waste material is thermally decomposed in a primary combustion chamber of the incinerator resulting in the generation of combustible waste gases which are fully combusted in a secondary zone. A hydraulically operated ram is mounted for reciprocating movement in the lower portion of the combustion chamber and a discharge door is located opposite the position of the ram. By partially extending the ram, the ram will enter the combustion chamber and agitate the waste without permitting the entry of air into the chamber. By fully extending the ram and opening the discharge door, the ash and non-combustible materials will be discharged from the combustion chamber for collection.

10 Claims, 8 Drawing Figures

APPARATUS FOR AGITATING AND REMOVING NON-COMBUSTIBLE MATERIAL FROM AN INCINERATOR

BACKGROUND OF THE INVENTION

The conventional excess-air incineration process attempts to achieve complete combustion of waste materials and combustion gases in the main combustion chamber. To achieve this objective, a large volume of air is introduced into the mass of the waste material, and secondary air is introduced into the upper portion of the combustion chamber in order to burn the combustible gases generated in the initial stage of combustion. The introduction of large volumes of air in the combustion chamber creates high turbulence which entrains ash and other particulate matter in the stack gases. The entrained material, unless removed from the stack gases by further processing can cause serious air pollution problems.

In a controlled air type of incineration process, lesser volumes of air are utilized and the amount of air supplied to the combustion chamber is controlled or varied in accordance with the rate of combustion. The controlled air system attempts to achieve only partial combustion of the waste material at high temperatures, resulting in the pyrolysis of organic matter to combustible gases which are completely combusted in a secondary thermal reaction zone.

A starved air combustion system also operates on pyrolytic principles and differs from a controlled air system in that air is introduced at a constant rate only into the lower end of the combustion chamber and no air is introduced into the upper portion of the combustion chamber. The combustible gases are completely combusted by thermal reaction in the stack by introducing either forced air, or air by natural aspiration, into the stack.

The use of a starved air system has advantages over a conventional incineration process in that there is less turbulence in the main combustion chamber, so that the quantity of non-combustibles in the stack gases is minimized. The starved system also provides economies in fuel and air requirements over a conventional incineration process.

When burning certain highly compacted materials such as computer program cards, telephone books, or material that become amorphous when heated, is is difficult to introduce the air into the mass of the highly compacted waste. With the conventional excess-air incineration process, movable grates are frequently employed which act to agitate the waste material to obtain better air-waste contact. However, movable grates are not normally used with a starved air system because of the high temperatures in the bed, and the grates without cooling provided by the relatively high underfire air flow, such as required by the conventional incinerator, would have a limited service life at these extreme temperatures.

SUMMARY OF THE INVENTION

The invention relates to an apparatus for agitating and removing non-combustible materials from a combustion chamber which requires that entrance of extraneous air be limited, such as a pyrolytic incinerator. The incinerator includes a housing which defines a combustion chamber wherein waste material is thermally decomposed in a starved air atmosphere, resulting in the generation of combustion gases which are fully combusted in a second combustion zone. Air is introduced into the second combustion zone either through a forced air system or by natural aspiration to completely combust the waste gases.

In accordance with the invention a hydraulically operated ram is mounted for reciprocating movement in the lower portion of the primary combustion chamber. Located opposite the position of the ram is a discharge door. By partially extending the ram through operation of a hydraulic system, the ram will enter the combustion chamber and agitate the highly compacted waste without permitting the entry of additional air into the combustion chamber. By fully extending the ram and opening the discharge door, the ash and other non-combustible materials can be discharged from the combustion chamber to a collection site.

The use of the ram acts to agitate highly compacted waste material to thereby obtain more efficient air-waste contact without upsetting the air volume and pressure balance, while also enabling non-combustible material to be discharged from the combustion chamber without the necessity of shutting down operation of the incinerator.

As the ram, except for the refractory head, is in the combustion zone only for short periods of time, the ram need not be fabricated from expensive heat resistant metals.

Automatic controls can be incorporated to tie the operation of the ram with the combustion rate, so that the ram will be operated when the stack temperature falls below a predetermined value, thereby providing a more uniform combustion rate.

Other objects and advantages will appear in the course of the following description.

DESCRIPTION OF THE DRAWINGS

The drawings illustrate the best mode presently contemplated of carrying out the invention.

In the drawings:

FIG. 7 is a section taken along line 7—7 of FIG. 3; and

DESCRIPTION OF THE PREFERRED EMBODIMENT

Figure 6:
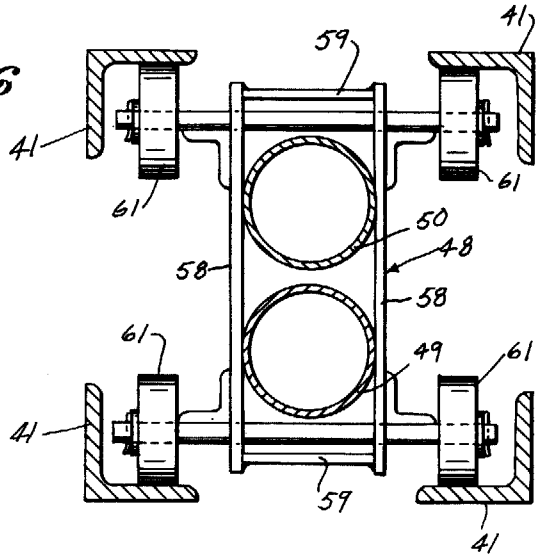
FIG. 6 is a section taken along line 6—6 of FIG. 3.
Figure 8:
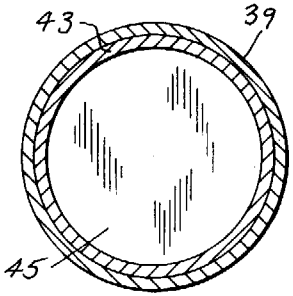
FIG. 8 is a section taken along line 8—8 of FIG. 2.

The drawings illustrate a pyrolytic incinerator which can be similar to that disclosed in U.S. patent application Ser. No. 333,884, filed Feb. 20, 1973, and now abandoned.

The apparatus, in general, includes a housing 1, which defines a combustion chamber 2. Waste material is adapted to be fed to the combustion chamber through a feed mechanism 3. Waste gases of combustion, which are generated by combustion of the waste material in the combustion chamber, are discharged through a stack 4, while ash and other non-combustible materials are removed from the combustion chamber by a removal unit 5.

Figure 1:
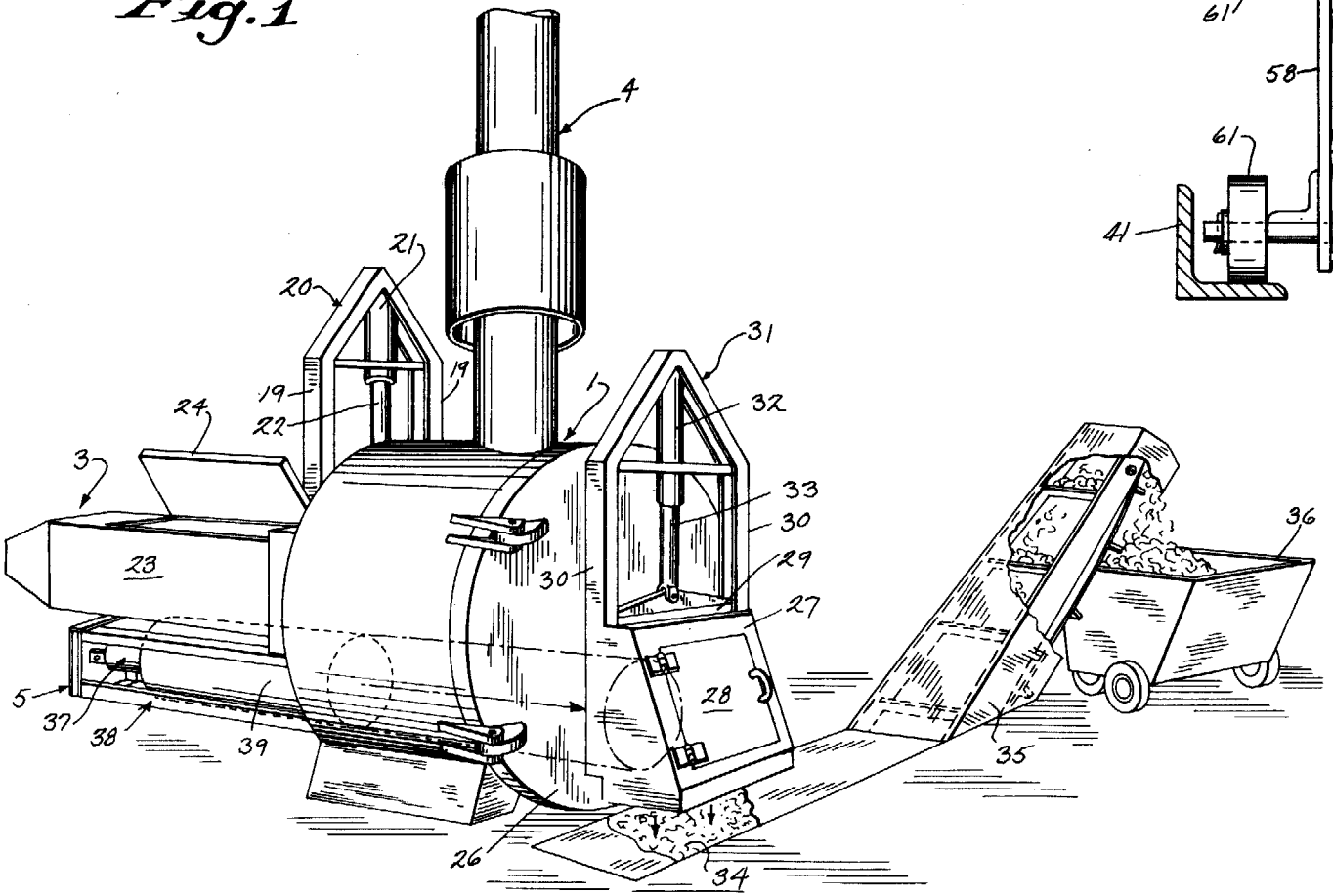
FIG. 1 is a perspective view of a pyrolytic incinerator incorporating an apparatus for agitating and removing non-combustible materials.
Figures 1, 2:
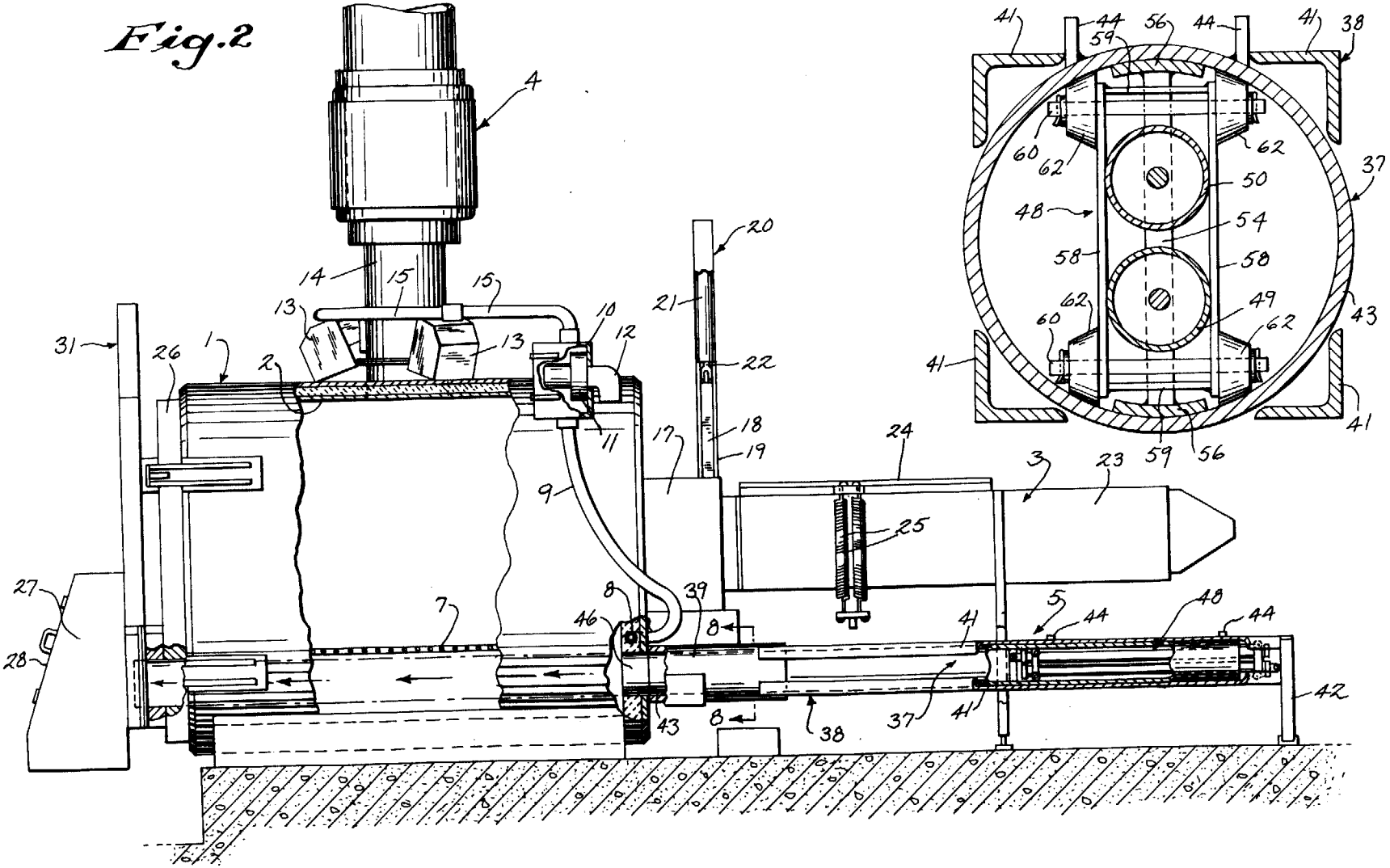
FIG. 2 is a side elevation of the incinerator shown in FIG. 1 with parts broken away in section.

The housing 1 is generally cylindrical in shape and is formed of an outer steel layer which is lined with a suitable refractory material. To introduce air into the lower end of the combustion chamber, a pair of air ducts 7 are located in the lower end of the chamber and the ends of the ducts 7 are connected to a manifold 8. Manifold 8, as shown in FIG. 2, is connected by a flexible tube 9 to a blower casing 10 which is mounted on the outside of housing 1. A blower 11 or other air moving device, is mounted within the casing 10 and air is supplied to the blower 11 through an inlet 12. With this construction, air will be drawn from the atmosphere by the blower 11 and will be discharged through the holes in the air ducts 7 into the mass of waste material located in the combustion chamber.

The pyrolytic incinerator operates on a starved air principle in which there is no air introduced directly into the upper end of the combustion chamber. The waste gases of combustion are discharged into the stack 4 and are fully combusted in one of more combustion zones. To effect combustion of the waste gases, one or more burners 13 are mounted in the lower end of the stack, and air is supplied to the lower stack section 14 through lines 15, which are connected to the blower 11. In addition, the lower end of the upper stack section 16 is spaced outwardly from the upper end of the lower stack section 14 to provide an annular chamber, and air is drawn from the atmosphere by a natural aspirating action through the annular chamber into the interior of the upper stack section 16 to provide complete combustion of the waste gases.

The feed mechanism 3 in itself forms no part of the present invention and includes a housing 17 which is secured to housing 1 and communicates with a feed opening in the housing 1. A guillotine type door 18 is adapted to close off the outer end of the housing 17, and as shown in FIG. 2, the door is mounted for sliding vertical movement between a pair of guide members 19 which constitute a portion of the frame 20. The door 18 is moved between the open and closed position by a cylinder 21 which is connected to the frame 20, while the lower end of the piston rod 22, which is slidable within cylinder 21, is attached to the upper edge of the door 18. Retraction of piston rod 22 will move the door to the open position so that feed material can be introduced into the combustion chamber.

Extending outwardly from a housing 17 is a hopper 23 having an open upper end which is enclosed by a loading door 24. Counterbalancing springs 25 are attached to the edge of the door and aid in moving the door to the open position so that waste material can be deposited in the hopper 23.

A hydraulically operated ram, not shown, is located in the hopper and acts to push the waste material through the open door 18 in housing 17 into the combustion chamber.

The end of the housing 1 opposite the feed mechanism 3 is enclosed by a hinged door 26, and the lower portion of door 26 is provided with an opening which communicates with a housing 27 mounted on the outer surface of the door 25. An access door 28 is provided in the housing 27.

The discharge opening in the door 26 is adapted to be closed by a guillotine-type closure 29 which is similar to the closure or door 18. Door 29 is mounted for vertical movement within spaced vertical guides 30 of frame 31 which extends upwardly from the housing 27. A hydraulic cylinder 32 is secured to the frame 31, and the piston rod 33 which is mounted for sliding movement within the cylinder 32 is connected to the upper edge of the door 29. By retracting the piston rod 33 the door 29 will be moved to the open position.

Located beneath the open lower end of housing 27 is a pit 34, and ash and non-combustible material being discharged through the opening in door 26 will fall into the pit 34 where it can be conveyed by a conveyor 35 into a wagon 36, or to any other type of collection site. Fog nozzles may be incorporated in housing 27 to cool the ash and aid in controlling flyash.

In accordance with the invention, an apparatus is included for agitating and removing non-combustible materials from the combustion chamber without the entry of additional air into the combustion chamber. The apparatus includes a ram 37 which is mounted for reciprocating movement within the lower end of the combustion chamber 2. Ram 37 is guided in movement by a frame 38 which extends outwardly from the housing 1 and is located below the feed mechanism 3. Frame 38 includes a cylindrical housing 39 which is secured to the housing 1 and communicates with an opening 40 in the housing 1. Extending outwardly from the housing 39 are four parallel angles 41, and the outer ends of the angles are connected together by an end support structure 42.

The ram 37 includes a generally cylindrical body section 43 and guide tabs 44 extend up from the cylindrical section 43 and are adapted to ride against the edges of the horizontal legs of the upper angle 41, as shown in FIG. 7, to thereby prevent rotation of the ram with respect to the frame 38.

A plate 45 is secured across the outer end of the cylindrical section 43 of ram 37 and a refractory head 46 is attached to the plate by a series of anchors 47. When the ram is in the retracted position, the outer surface of the head 46 will be substantially flush with the inner surface of the refractory liner 6 of the housing 1. The length of the ram 37 may be slightly greater than the width of the combustion chamber so that when the ram is fully extended, the head 46 will project into the housing 27.

The ram 37 is adapted to be moved into the combustion chamber by a dual cylinder assembly 48 which includes a pair of hydraulic cylinders 49 and 50. A piston rod 51 is mounted for sliding movement within the cylinder 49 and the outer end of the rod 51 is connected to lugs 52 which are connected to the end support structure 42. The piston rod 53 of cylinder 50 is connected to a vertical plate 54 of yoke 55. The yoke 55 includes a pair of horizontal arms 56 which extend outwardly from the vertical plate 54 at diametrically opposite locations and are attached to the cylindrical section 41 of ram 37 by bolts 57 so that the yoke 55 and ram 37 are integrally connected.

The cylinders 49 and 50 are connected together by two pair of plates 58, and the ends of the corresponding plate 58 are connected together by cross plates 59. Shafts 60 extend through aligned openings in plates 58. The shafts associated with the plates 58 at the outer ends of the cylinders 49 and 50 carry wheels 61 which are adapted to ride on the horizontal legs of the angles 41, as shown in FIG. 6, while the shafts 60 associated with the plates 58 at the inner ends of the cylinders carry rollers 62 having tapered outer surfaces that ride on the inner surface of the cylindrical section 43 of the housing.

Figure 3:
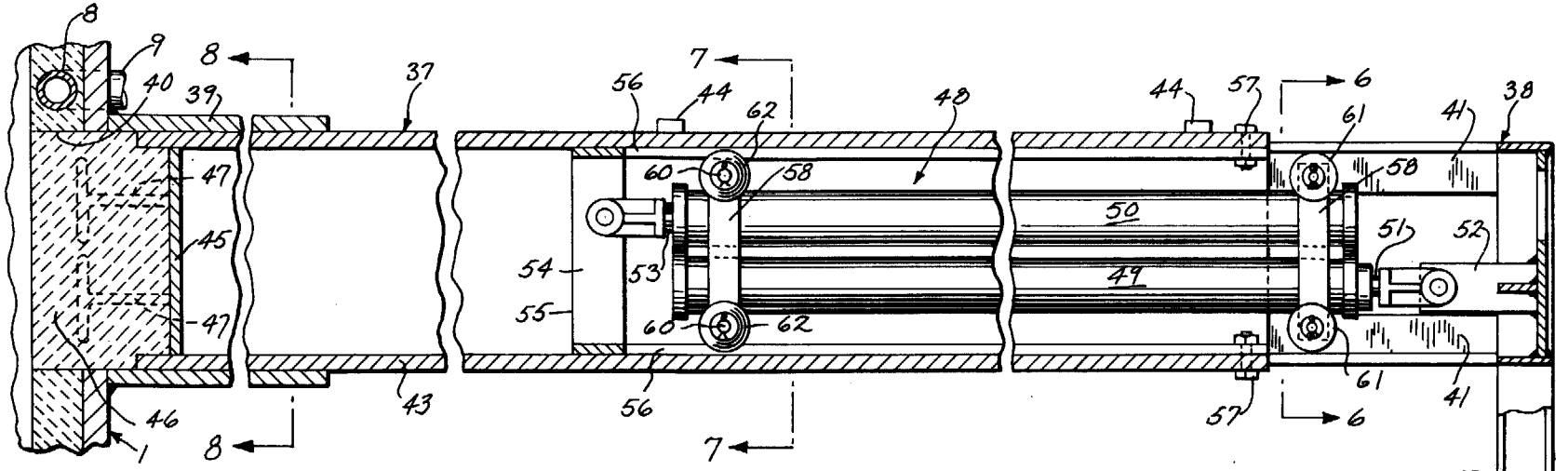
FIG. 3 is a fragmentary enlarged side elevation showing the ram construction.
Figure 4:
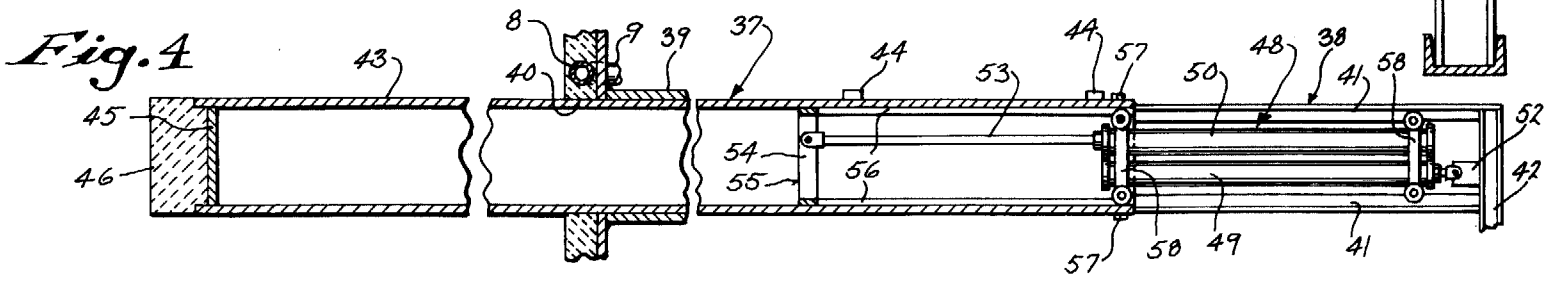
FIG. 4 is a view similar to FIG. 3 showing the ram partially extended.
Figure 5:
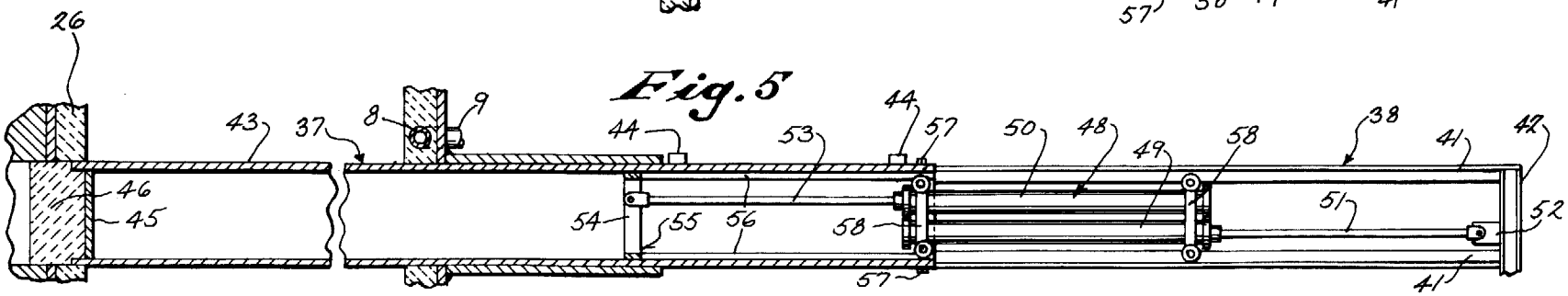
FIG. 5 is a view similar to FIG. 4 showing the ram fully extended.

FIG. 3 illustrates the position of the cylinders when the ram is in the retracted position. When it is desired to agitate the waste within the combustion chamber 2, hydraulic fluid is introduced into the outer end of the cylinder 50, thereby extending the piston rod 53, which is attached to the yoke 55, and moving the ram 37 inwardly of the combustion chamber to thereby agitate the waste material. Subsequently, hydraulic fluid can be introduced into the inner end of cylinder 49 causing the cylinder 49 to move relative to the piston rod 51, which is attached to the fixed support 42, and the ram 37 will be moved in a second increment of movement across the combustion chamber.

Partially extending the ram not only acts to agitate the waste to improve the air-waste contact, but also urges the partially pyrolyzed waste toward the discharge opening where the waste can be completely pyrolyzed and fixed carbon fractions can be combusted prior to removal of the non-combustible residue from the combustion chamber. When it is desired to discharge the non-combustible material from the combustion chamber, the door 29 will be opened and the ram 37 is extended in a full stroke of travel to push the non-combustible material through the discharge opening 26 and into the housing 27 where it will fall into the pit 34 for delivery to the collection site.

With this construction, the operator through operation of the hydraulic system can move the ram with any desired stroke of movement into the combustion chamber to agitate the waste material and thereby provide better waste-air contact. This is particularly important when burning highly compacted materials or burning amorphic material, such as certain plastics. The agitation can be accomplished without additional air being admitted to the combustion chamber, and thus the delicate air volume and pressure balance will not be disturbed by operation of the ram.

During the combustion process, the operator can discharge the non-combustible material from the combustion chamber without shutting down operation of the incinerator by fully extending the ram while opening the discharge door 29, so that the ram will thereby push the non-combustible material out of the discharge opening to the exterior.

The ram, except for the refractory head, is exposed to the extreme temperatures of the combustion zone only for short periods of time while the ram is extended and retracted. Therefore, it is not necessary to construct the ram from expensive heat resistant alloys.

It is possible to incorporate automatic controls with the operation of the ram so that the ram will be operated to agitate the combustible material when the stack temperature falls below a predetermined value.

Various modes of carrying out the invention are contemplated as being within the scope of the following claims particularly pointing out and distinctly claiming the subject matter which is regarded as the invention.

I claim:

1. An apparatus for agitating and removing non-combustible material from a combustion chamber, comprising a housing defining a chamber to receive waste material and having a discharge opening and having a second opening aligned with the discharge opening, a door to enclose said discharge opening and movable between an open and a closed position, a ram disposed for movement within said second opening between a retracted position wherein the ram is located outside of the chamber and an extended position wherein the ram extends across said chamber toward said discharge opening, and a cylinder unit disposed outside of said housing and operably connected to said ram for moving said ram between said retracted and extended positions, said cylinder unit includes a pair of generally parallel vertically disposed cylinders with each cylinder having a piston rod slidably disposed therein, the piston rod of the lower cylinder of said pair being connected to a fixed object and the piston rod of the upper cylinder of said pair being connected to said ram, and connecting means for connecting the cylinders together, extension of the piston rod with respect to said upper cylinder acting to move the ram in a first stroke of movement and extension of said lower cylinder with respect to its piston rod acting to move the ram in a second stroke of movement, partial extension of said ram acting to agitate the waste material in the chamber and urge the partially combusted waste toward said discharge opening and full extension of said ram acting to discharge non-combustible material through said discharge opening.

2. The apparatus of claim 1, and including guide means for guiding the ram in reciprocating movement between said retracted and extended positions.

3. An apparatus for agitating and removing non-combustible materials from a combustion chamber, comprising a housing defining a combustion chamber to receive waste material and having a discharge opening for the discharge of non-combustible material and having a second opening spaced from said discharge opening and aligned therewith, said openings being spaced above the bottom of the combustion chamber, a door to enclose the discharge opening and movable between an open and a closed position, air supply means disposed in the lower portion of said housing for supplying air to said combustion chamber, a ram mounted for sliding reciprocating movement within said second opening, said ram movable between a retracted position wherein the end of the ram is located substantially flush with the inner surface of the housing to an extended position wherein the ram extends across said combustion chamber toward said discharge opening, operating means operably connected to the ram for moving the ram between the retracted and extended positions, partial extension of said ram acting to agitate the waste material in the chamber and urge the partially combusted waste toward said discharge opening and full extension of said ram acting to discharge non-combustible material through said discharge opening, and collection means located outside of the housing to receive the discharged non-combustible material.

4. The apparatus of claim 3, wherein the ram is provided with a hollow section, and said operating means comprises a fluid operated cylinder connected to said ram, said cylinder being located within said hollow section when said ram is in the retracted position.

5. The apparatus of claim 3, and including guide means bordering said second opening and extending outwardly from said housing for guiding the ram in reciprocating movement, said ram being in a substantially hermetically sealed relation with said guide means whereby air will be prevented from entering the combustion chamber through the joint between said guide means and said ram during movement of said ram.

6. A method of pyrolytic incineration, comprising the steps of providing a combustion chamber having a discharge opening for the discharge of non-combustible material and having a second opening spaced from the discharge opening and aligned therewith, introducing combustible waste into said combustion chamber, combusting said waste in said chamber, introducing air into the lower end of the combustion chamber, discharging the waste gases of combustion from the upper end of the combustion chamber, moving a ram into the combustion chamber through said second opening and into the mass of the combustible waste material while the waste is being combusted therein to increase the effectiveness of the combustion process.

7. The method of claim 6, wherein the step of moving the ram comprises advancing the ram partially across the combustion chamber to provide agitation and improved air-waste contact while urging the partially combusted waste material toward said discharge opening.

8. The method of claim 6, wherein the step of moving the ram comprises advancing the ram completely across the combustion chamber to said discharge opening to thereby discharge non-combustible material from the combustion chamber.

9. The apparatus of claim 1, wherein said connecting means comprises a connecting frame, and said apparatus includes guide means for guiding the frame for movement as the piston rod of the lower cylinder is extended and retracted.

10. The apparatus of claim 9, wherein said ram includes a hollow section disposed radially outward of said frame when the ram is in the retracted position, said guide means including a plurality of wheels connected to the frame and said guide means including a track connected to the housing, a group of said wheels being disposed to ride on the inner surface of the hollow section of the ram as the piston rod of the upper cylinder is extended and retracted.

* * * * *